US006976466B2

(12) United States Patent
Gibisch et al.

(10) Patent No.: US 6,976,466 B2
(45) Date of Patent: Dec. 20, 2005

(54) CYLINDER BLOCK AND CRANKCASE FOR A LIQUID-COOLED INTERNAL-COMBUSTION ENGINE

(75) Inventors: Rudolf Gibisch, Unterschleissheim (DE); Johann Wolf, Ottobrunn (DE); Rudolf Flierl, Kaiserslautern (DE)

(73) Assignee: Bayerische Motoren Werke AG, Munich (DE)

( * ) Notice: Subject to any disclaimer, the term of this patent is extended or adjusted under 35 U.S.C. 154(b) by 210 days.

(21) Appl. No.: 10/416,724

(22) PCT Filed: Feb. 8, 2002

(86) PCT No.: PCT/EP02/01313

§ 371 (c)(1),
(2), (4) Date: May 14, 2003

(87) PCT Pub. No.: WO02/073021

PCT Pub. Date: Sep. 19, 2002

(65) Prior Publication Data

US 2004/0035375 A1 Feb. 26, 2004

(30) Foreign Application Priority Data

Mar. 14, 2001 (DE) ..... 101 12 132

(51) Int. Cl.[7] ..... F02F 7/00
(52) U.S. Cl. ..... 123/195 R; 123/193.2
(58) Field of Search ..... 123/195 R, 41.74, 123/41.84, 196 R

(56) References Cited

U.S. PATENT DOCUMENTS 2,974,654 A * 3/1961 Bouvy ..... 123/54.4
3,568,573 A * 3/1971 Bailey et al. ..... 92/171.1

(Continued)

FOREIGN PATENT DOCUMENTS

| | | | |
|---|---|---|---|
| DE | 43 06 269 | A1 | 2/1994 |
| DE | 44 09 750 | A1 | 9/1995 |
| DE | 195 40 763 | C1 | 12/1996 |
| DE | 197 32 838 | A1 | 2/1999 |
| DE | 100 21 198 | A1 | 3/2001 |
| DE | 100 26 216 | A1 | 3/2001 |
| DE | 199 49 416 | A1 | 4/2001 |
| DE | 199 49 965 | A1 | 4/2001 |
| EP | 0 751 289 | A1 | 12/1992 |
| EP | 0 659 899 | A1 | 11/1994 |
| JP | 63111265 | A | 5/1988 |
| JP | 08021299 | A | 1/1996 |

OTHER PUBLICATIONS

International Preliminary Examination Report.
German Search Report.
International Search Report.

*Primary Examiner*—Henry C. Yuen
*Assistant Examiner*—Jason Benton
(74) *Attorney, Agent, or Firm*—Crowell & Moring LLP

(57) ABSTRACT

A cylinder block and crankcase for a liquid-cooled internal-combustion engine is to be constructed by composite casting, a magnesium case being cast around an aluminum power unit block. The cylinder block and crankcase is conceived such that the aluminum power unit block is significantly used for the distribution of force between the cylinder head and the crankshaft bearing caps as well as for the guiding of the cooling water, in which case, the magnesium case is free of a cooling water guidance and predominantly used for the guiding of lubricating oil and, in addition, is correspondingly designed for the proportional stiffening against bending and torsion loads.

20 Claims, 5 Drawing Sheets

U.S. PATENT DOCUMENTS 4,294,203 A * 10/1981 Jones ..... 123/195 R
4,515,112 A * 5/1985 Tsuchiya et al. ..... 123/41.84
4,523,555 A * 6/1985 Mezger et al. ..... 123/193.3
4,708,105 A * 11/1987 Leydorf et al. ..... 123/193.3
4,938,183 A 7/1990 Field et al.
5,148,782 A * 9/1992 Kramer et al. ..... 123/195 R
5,253,615 A * 10/1993 Heater et al. ..... 123/41.74
5,537,969 A * 7/1996 Hata et al. ..... 123/193.2
5,771,955 A 6/1998 Helgesen et al.
5,988,120 A * 11/1999 Betsch et al. ..... 123/41.74
6,129,057 A * 10/2000 Langer ..... 123/41.72
6,135,081 A 10/2000 Eidenboeck et al.
6,192,852 B1 2/2001 Gerhards et al.

* cited by examiner

CYLINDER BLOCK AND CRANKCASE FOR A LIQUID-COOLED INTERNAL-COMBUSTION ENGINE

The invention relates to a cylinder block and crankcase for a liquid-cooled internal-combustion engine.

For reducing the weight of a cylinder block and crankcase, it is known to produce the highly stressed power unit block formed essentially of the cylinders with directly or indirectly molded-on crankshaft bearings from a material which can withstand a higher stress and to construct the less stressed case walls separately of a lighter, particularly thin-walled constructed material, while taking into account a material-adapted separate guidance for liquid fuels.

From German Patent Document DE 43 06 269 A1, a cylinder block and crankcase for a liquid-cooled internal-combustion engine is known, in the case of which a power unit block with bearing blocks molded to a deck on the crankshaft side and cylinder pipes arranged above the latter is surrounded by a case shell, the case shell by way of a flange being in a sealable connection with the deck for separating the lubricating-oil-carrying crank space from a coolant space assigned to the cylinder pipes. For this cylinder block and crankcase illustrated only as a construction example, the use of different materials for the cylinder block and crankcase and the shell is conceivable; however, this cylinder block and crankcase is eliminated as a model for an operable internal-combustion engine.

In contrast, German Patent Document DE 44 09 750 A1 shows and describes this type of a cylinder block and crankcase for a liquid-cooled internal-combustion engine with a case consisting essentially of magnesium with a cylinder insert comprising several cylinder pipes arranged in series. For the material-adapted separate guidance of liquid fuels, the cylinder insert made of an aluminum alloy and surrounded by cast magnesium, in the cylinder-head-side end area, has an enveloping wall surrounding the mutually connected cylinder pipes, for constructing a coolant space, so that lubricating oil as a further liquid fuel is guided preferably in ducts constructed in the magnesium case. Although, in the case of this known cylinder block and crankcase, it is ensured that cooling water as the cooling medium is not guided in the magnesium case, this magnesium case with integrated bearing blocks of a light-weight construction is not very suitable for a high-performance internal-combustion engine.

In contrast, European Patent Document EP 0 751 289 B1 shows and describes a cylinder block and crankcase for a liquid-cooled internal-combustion engine, in the case of which a power unit block made of a ferrous material with bearing blocks arranged on a deck, on the one side, and cylinder pipes provided on the other side is used in an aluminum case produced by casting around. As illustrated in the drawings of this document, the cylinder head, which is not shown, is screwed into the aluminum case, whereas the bearing caps of the crankshaft bearings are screwed to the bearing blocks formed of the ferrous material. Thus, the flux of force between the cylinder head and the crankshaft bearing caps disadvantageously extends over materials with different coefficients of thermal expansion. This requires, for example, a cylinder head gasket with a particularly high pressure.

These problems are avoided in the case of a cylinder block and crankcase for a liquid-cooled internal-combustion engine according to German Patent Document DE 195 40 763 C1, in the case of which a power unit block made of a ferrous material with bearing blocks arranged on a deck, on the one side, and, on the other side, cylinder pipes provided in one piece are provided in addition to relatively free-standing screw channels for the cylinder head screwing. This relatively heavy-weight power unit block may be surrounded by a case of cast aluminum or magnesium alloy, in which case, however, in the case of a magnesium case, a high-expenditure corrosion protection must be provided in order to avoid a disadvantageous contact with the cooling water.

It is an object of the invention to provide, for a cylinder block and crankcase produced by composite casting and made of an aluminum and a magnesium alloy, with a material-adapted separate guidance of required liquid fuels, a structure which securely absorbs forces and moments.

This object is achieved by means of claim 1.

The advantage of the invention will then be that, on the one hand, the power unit block constructed with coolant spaces which is made of an aluminum alloy absorbs the flux of force between the cylinder head and the crankshaft bearing caps, and this power unit block, on the other hand, during the casting around of a magnesium alloy for the case by way of fillable openings and ducts, forms a bending-resistant and torsion-proof unit together with the aluminum power unit block, which unit is advantageously supported by targeted constructed details of the magnesium case.

Advantageous further developments are described in the subclaims.

The invention is described by means of an embodiment illustrated in the drawing.

Figure 1:
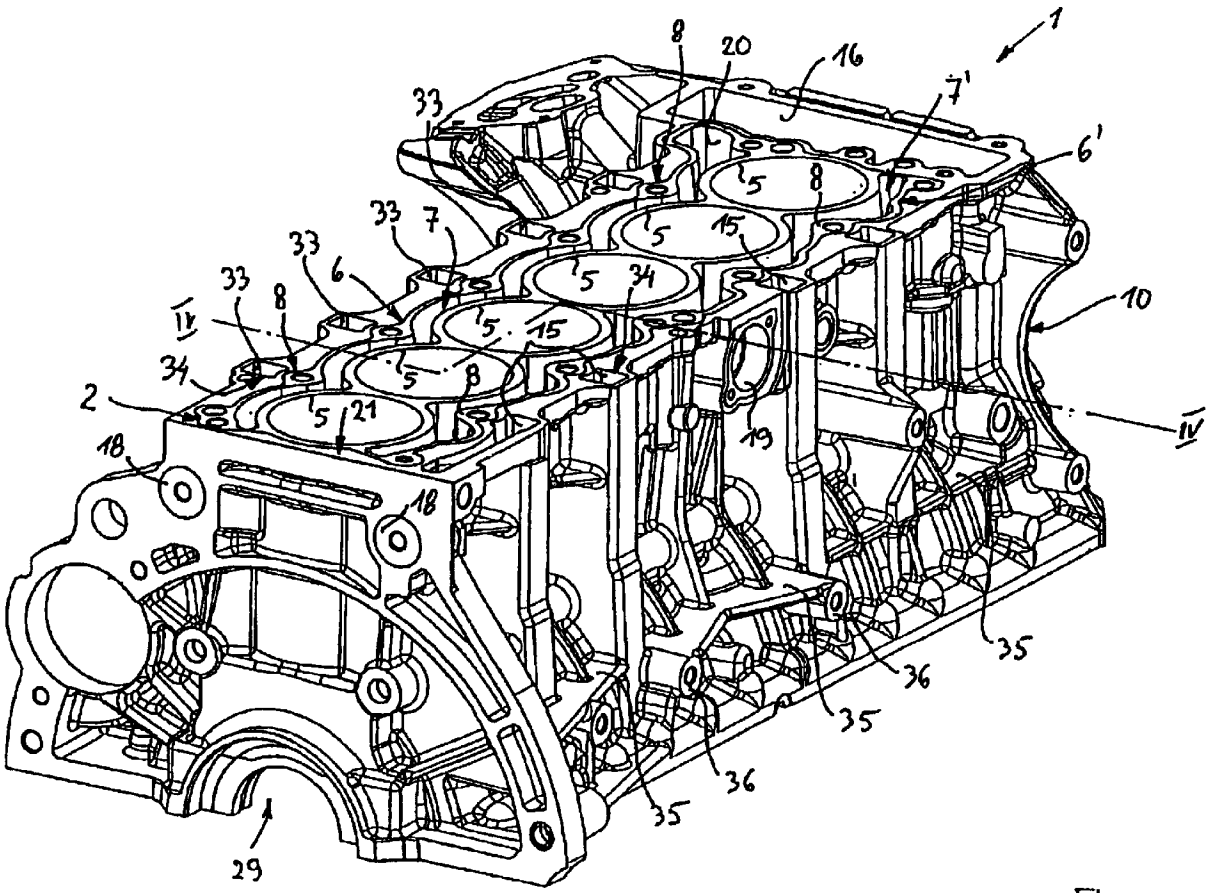
FIG. 1 is a perspective view of a cylinder block and crankcase.

A cylinder block and crankcase 1 for a liquid-cooled internal-combustion engine, which is not shown in detail, comprises a power unit block 2 which is made of an aluminum alloy and has bearing blocks 4 molded onto a deck 3 on the crankshaft side and cylinder pipes 5 arranged over the latter in one piece, which cylinder pipes 5 bound cylinder-head-side coolant spaces 7, 7' by means of enveloping walls 6, 6' molded to the cylinder pipes 5.

In the relatively short or low enveloping walls 6, 6', screw channels 8 are shaped out which are used for the screwing of the cylinder head and which are in a force-conducting connection with the deck 3 by way of webs 9, which are arranged in the cylinder pipes 5, to the bearing blocks 4. This advantageously ensures that the flux of force between the not shown cylinder head of the internal-combustion engine, which is not shown in detail, and the bearing caps corresponding with the bearing blocks 4 extends exclusively in the aluminum power unit block 2 which has a higher stability.

For achieving a light-weight and nevertheless highly rigid cylinder block and crankcase, the aluminum power unit block 2 is cast into a case 10 produced of a magnesium alloy with case wall sections 12, 12' bounding a crank space 11.

Figure 4:
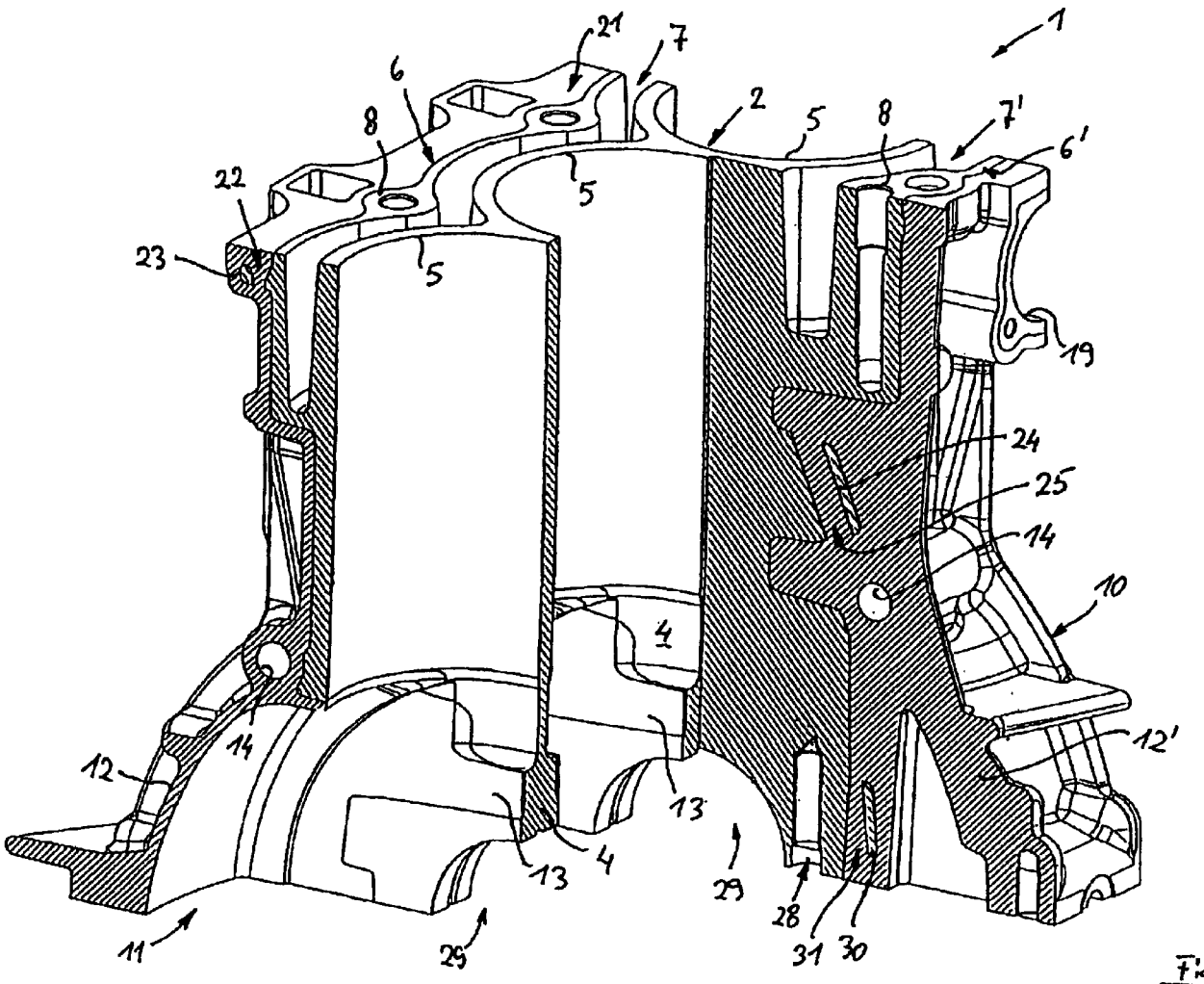
FIG. 4 is a sectional view according to Line IV—IV in the cylinder block and crankcase according to FIG. 1.

As illustrated in detail in FIG. 4, the mutually opposite case wall sections 12, 12' are connected with one another by way of transverse connections 13, a respective bearing block 4 being cast in the transverse connections 13 stiffening the case wall sections 12, 12'. Between the transverse connections 13 of the case wall sections 12, 12' and the bearing blocks 4 surrounded by the casting, shrink connections are advantageously achieved which are useful for the distribution of forces and moments on the aluminum power unit block 2 and magnesium case 10.

The magnesium case 10, which is exclusively constructed for the guiding of the lubricating oil with oil channels 14, 15, is stiffened, particularly stiffened with respect to torsion, in a first end area by means of a face-side shaft 16 arranged in one piece.

In the other, second end area, the magnesium case 10 encloses threaded eyes 18 arranged at the aluminum power unit block 2 and supported by way of ribs 17, which threaded eyes 18 are used for a releasable connection of a clutch housing or transmission housing which is not shown.

For achieving an additional clamping between the magnesium case 10 and the aluminum power unit block 2, openings and fillable channels are additionally provided in a distributed manner on the aluminum power unit block 2 which are penetrated by the magnesium alloy during the casting.

Figure 2:
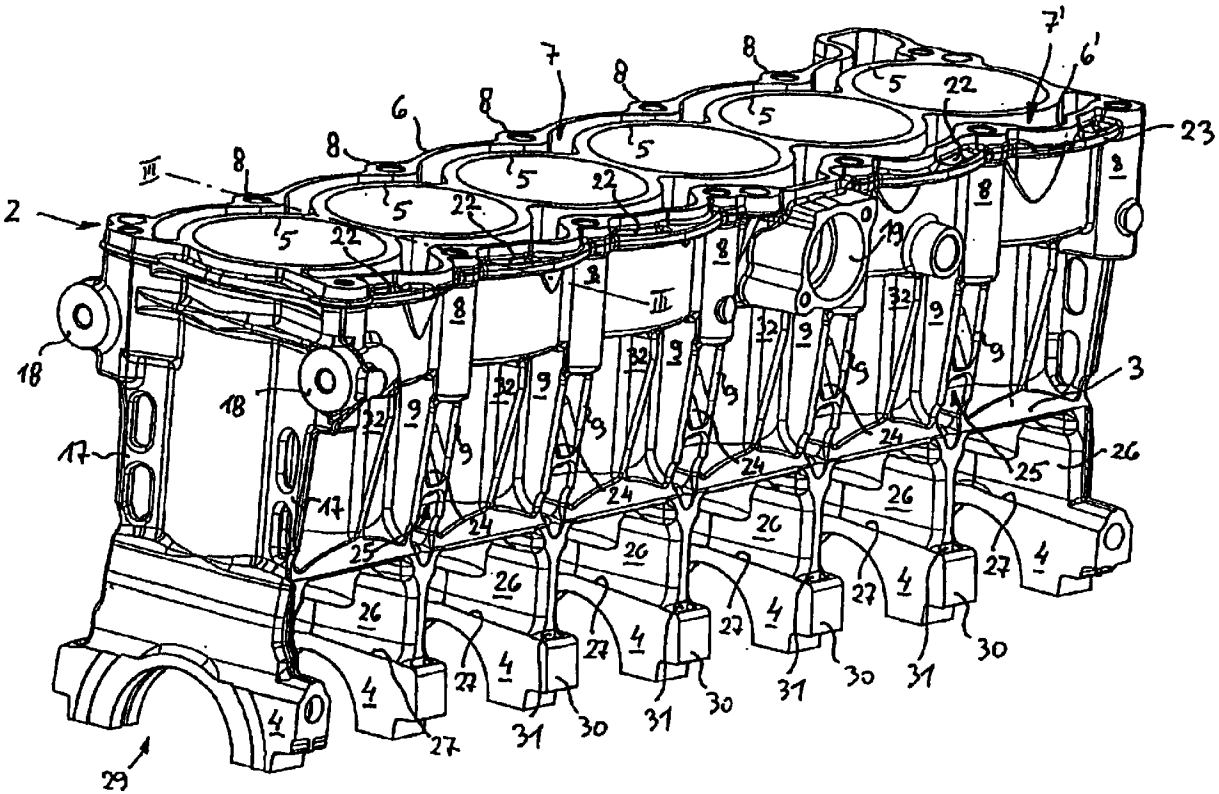
FIG. 2 is a perspective view of a power unit block according to the invention.

As illustrated in FIG. 2, the aluminum power unit block 2 comprises cylinder pipes 5 connected with the deck 3 and with one another, whereby the enveloping walls 6, 6' bound coolant spaces 7, 7' separated from one another by way of the connected cylinder pipes 5. As also illustrated in FIG. 2, the exhaust-gas-side coolant space 7' is provided with an aluminum inflow piece 19 penetrating the magnesium case 10. Furthermore, the air-intake-side coolant space 7 comprises a discharge uptake 20 arranged in the first end area of the aluminum power unit block 2, which discharge uptake 20 is connected with a cylinder-head-side connection.

As illustrated in FIGS. 1 and 4, the cylinder tubes 5 and the enveloping walls 6, 6' of the aluminum power unit block 2 together with the magnesium case 10 on the cylinder head side end flush in a common sealing surface 21, in which case, for an additional linking close to the sealing surface, the magnesium case 10 is additionally form-lockingly connected by means of openings 22 in flanges 23, which can be penetrated during the casting, which flanges 23 connect screw channels 8 on the enveloping walls 6, 6' on the exterior side under the sealing surface 21.

Figure 3:
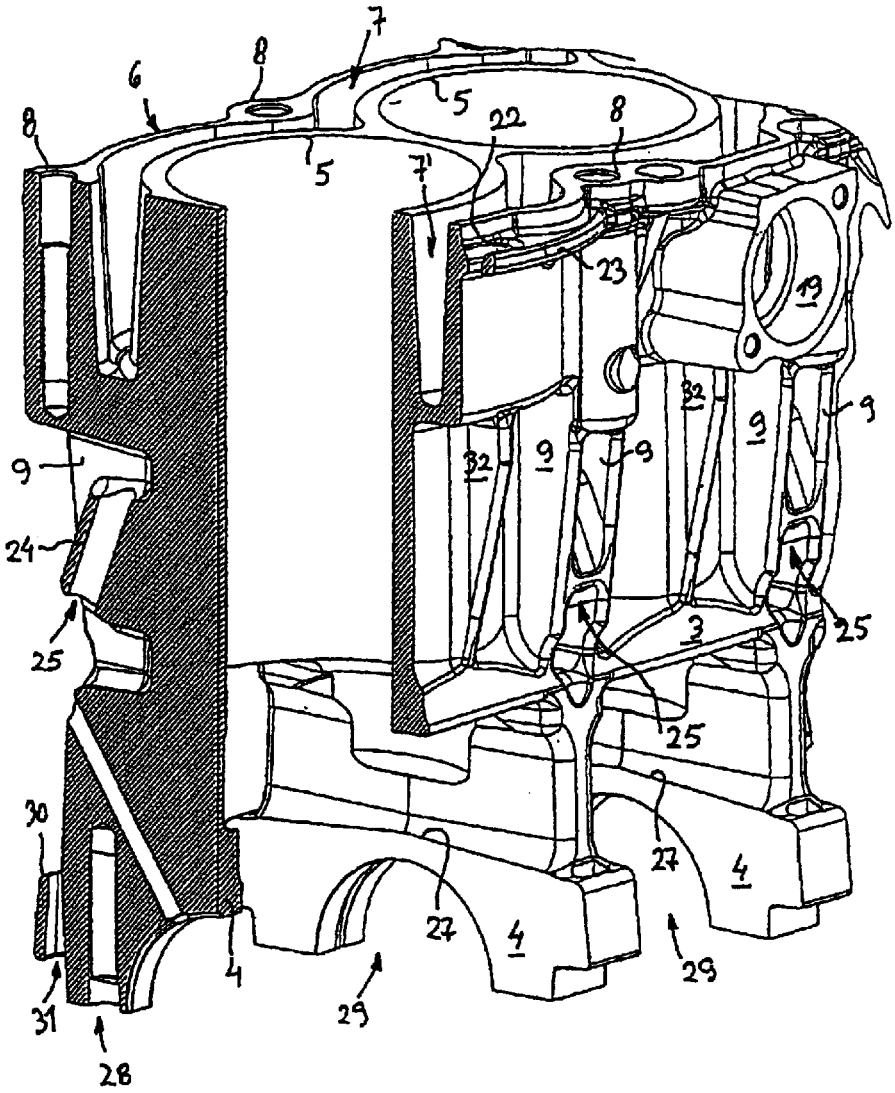
FIG. 3 is a sectional view of the power unit block according to Line III—III in FIG. 2.

FIGS. 2 and 3 illustrate that the screw channels 8 are constructed to project over the enveloping walls 6, 6' on the deck side and are in each case connected with the deck 3 in a force-conducting manner by way of two webs 9 which are arranged in a mutually spaced manner below the coolant spaces 7, 7' on the cylinder pipes 5. Together with a cylinder pipe section, on the one side, and a web-connecting partition 24, on the other side, the two webs 9 form a duct 25—FIG. 4—which can be filled by casting material during the casting of the magnesium case 10 around the aluminum power unit block 2, for the form-locking clamping together of the magnesium case 10 with the aluminum cylinder insert 2 approximately at half the case height.

Particularly as illustrated in FIG. 2, the bearing blocks 4 at the aluminum power unit block 2, on both faces respectively, have a groove-type indentation 26 for the regional cross-sectional increase of the transverse connections 13 of the magnesium case 10, whereby advantageously large-cross-section belts are achieved in the transverse connections 13 for the advantageous stiffening of the case wall sections 12, 12' of the case 10. In view of the screwed bearing cap connections in the aluminum bearing blocks 4, crankshaft-side boundaries 27 of the indentations 26 are arranged at a distance from the bearing center plane of a divided crankshaft bearing 29 which is sufficient for a load-bearing screwed bearing cap connection 28 in the bearing blocks 4.

For increasing the form-locking clamping-together of the transverse connections 13 of the magnesium case 10 with the aluminum bearing blocks 4, the bearing blocks 4 according to FIG. 2 have lateral extensions 30 with openings 31 which, during the casting of the magnesium case 10, can be filled by the casting material. By means of this further development, the magnesium case 10 can also be clamped at the lower end to the aluminum power unit block 2.

As illustrated particularly in FIG. 3, the cylinder pipes 5, between the deck 3 and the underside of the respective coolant space 7, 7', have stiffening ribs 32 arranged approximately in the center between the webs 9 of the screw channels 8. These stiffening ribs 32 used for the stiffening of the cylinder pipes 5 advantageously enlarge the surface of the aluminum power unit block 2 for the material-locking linking of the magnesium case 10.

For the additional reinforcing or stiffening of the cylinder block and crankcase 1, the bearing caps which correspond with the bearing blocks 4 and are not shown, may be integrated in a bearing frame which is not shown, the crankshaft bearings 29, for achieving a low running play, optionally comprising cast-in parts formed of a ferrous material.

A further stiffening against bending and torsion loads is finally achieved in that venting ducts 33 and oil return flow ducts 15 are provided in the magnesium case 10 which are arranged to be distributed over the two longitudinal sides, which ducts 33, 15 each have a rectangular cross-section 34 oriented transversely to the longitudinal axis of the machine, the walls of the ducts 15, 33 being connected with the longitudinal case ribs 35, and, in the connection areas of the ducts and longitudinal ribs 35, screw pockets 36 designed for aluminum screws being provided for the connection of engine support elements and/or auxiliaries.

Figure 5:
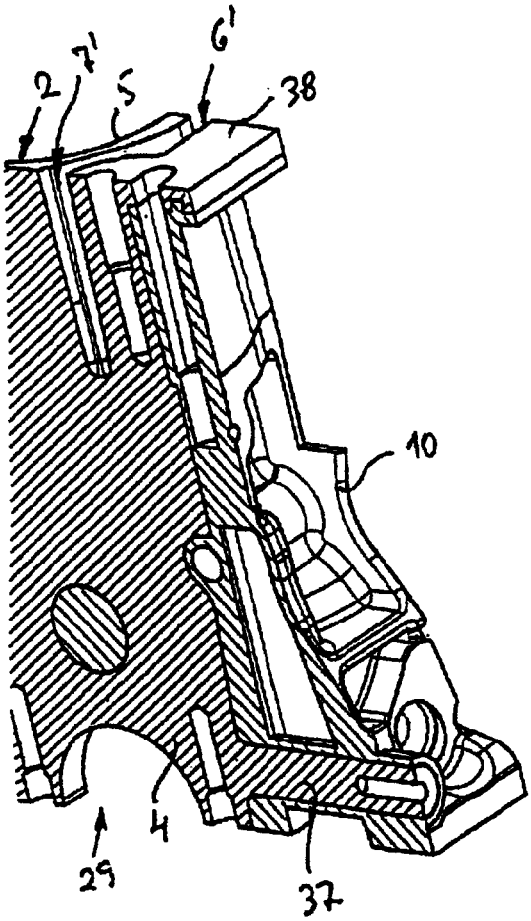
FIG. 5 is a detailed sectional view of a cylinder block and crankcase of a modified construction.

For achieving higher stressable connection points, on one or several of the bearing blocks 4 arranged on the aluminum power unit block 2, laterally oriented pin 37 may be arranged which penetrate the magnesium case 10 and each have a screw-in thread for aluminum screws for fastening separate devices (FIG. 5).

Finally, for achieving a sealing surface 21 of a uniform material, it may also be provided that the aluminum power unit block 2 has sealing flanges 38 on the enveloping walls 6, 6' which are designed flush with the cylinder pipes 5 and cover the magnesium case 10.

The above-mentioned bearing frame accommodating the bearing blocks 4 is preferably also made of a magnesium alloy.

The cylinder block and crankcase 1 designed according to the invention is conceived such that, of the liquid fuels, the cooling water is exclusively carried in aluminum parts, whereas the lubricating oil is predominantly delivered in magnesium parts.

A eutectic or hypereutectic alusil compound is preferably considered to be used as the aluminum alloy.

What is claimed is:

1. A cylinder block and crankcase for a liquid-cooled internal-combustion engine, comprising:

a power unit block made of an aluminum alloy and including, a crankshaft side and a cylinder head side, a deck on the crankshaft side, bearing blocks molded to the deck, cylinders arranged in one piece above the deck, enveloping walls, cylinder head side coolant spaces surrounded by the enveloping walls, channels for fastening the cylinder head, which are placed in the enveloping walls, webs arranged on the cylinders, wherein the channels are connected to the deck by the webs, and openings and fillable ducts; and a case constructed of a magnesium alloy and cast around the aluminum power unit block, the case including transverse connections case wall sections surrounding a crank space, the case wall sections being connected with one another with the transverse connections with the bearing blocks, oil ducts, a first end area and a second end area, a face-side duct stiffening the first end area, threaded eyes disposed in the second end area and arranged at the aluminum power unit block, ribs supporting the threaded eyes for the releasable connection of a clutch housing or transmission housing, and wherein the case is additionally connected with the aluminum power unit block by penetrating the openings and fillable ducts of the aluminum power unit block with the magnesium alloy of the case.

2. The cylinder block and crankcase according to claim 1, wherein the cylinders are connected with the deck and with one another, the enveloping walls and the cylinders surround the coolant spaces, the coolant spaces include an exhaust-gas-side coolant space that is in fluid communication with an aluminum inflow connection extending through the magnesium case, and the coolant spaces further include an air-intake-side coolant space that is in fluid communication with a discharge uptake arranged in the first end area of the aluminum power unit block.

3. The cylinder block and crankcase according to claim 2, wherein the cylinders and the enveloping walls of the aluminum power unit block are flush with the magnesium case on the cylinder head side to form a common sealing surface, and the magnesium case includes flanges having openings, which can be penetrated during casting, which flanges are connected with the screw channels on the enveloping walls on the exterior side under the sealing surface.

4. The cylinder block and crankcase according to claim 3, wherein the screw channels project over the enveloping walls on the deck side and are connected with the deck by the webs which are arranged below the coolant spaces on the cylinders, the cylinder block and crankcase further include a cylinder section and a web-connecting partition, and the webs, the cylinder section and the web-connecting partition form a duct which, during the casting of the magnesium case around the aluminum power unit block, is filled by casting material.

5. The cylinder block and crankcase according to claim 4, wherein the bearing blocks have a groove-type indentation to increase regional cross-section of the transverse connections of the magnesium case, and crankshaft-bearing-side boundaries of the indentations are arranged at a distance from the center bearing plane of a divided crankshaft bearing which is sufficient for a load-bearing bearing cap connection in the bearing blocks.

6. The cylinder block and crankcase according to claim 5, wherein bearing blocks have lateral extensions with openings, which, during the casting of the magnesium case, are filled by casting material, for the clamping of the transverse connections of the magnesium case with the aluminum bearing blocks.

7. The cylinder block and crankcase according to claim 6, wherein the cylinders have stiffening ribs arranged between the deck and an underside of the coolant space approximately in the center between the web pairs of the screw channels.

8. The cylinder block and crankcase according to claim 7, further comprising bearing caps corresponding to the bearing blocks, wherein the bearing caps are integrated in a bearing frame, and wherein the crankshaft bearing comprises cast-in parts made of a ferrous material.

9. The cylinder block and crankcase according to claim 8, wherein the magnesium case includes venting and oil return flow ducts arranged over the two longitudinal sides, which ducts each have a rectangular cross-section oriented transversely to the longitudinal axis, the walls of the ducts are connected with longitudinal case ribs, and in connection areas of the ducts and longitudinal ribs, screw pockets designed for aluminum screws are provided for the connection of at least one of engine support elements and auxiliaries.

10. The cylinder block and crankcase according to claim 9, wherein on at least one of the bearing blocks, laterally oriented pins are arranged which penetrate the magnesium case and each have a screw-in thread for aluminum screws.

11. The cylinder block and crankcase according to claim 10, wherein the aluminum power unit block has sealing flanges which are constructed flush with the cylinders on the enveloping walls and cover the magnesium case.

12. The cylinder block and crankcase according to claim 1, wherein the cylinders and the enveloping walls of the aluminum power unit block are flush with the magnesium case on the cylinder head side to form a common sealing surface, and the magnesium case includes flanges having openings, which can be penetrated during casting, which flanges are connected with the screw channels on the enveloping walls on the exterior side under the sealing surface.

13. The cylinder block and crankcase according to claim 12, wherein the screw channels project over the enveloping walls on the deck side and are connected with the deck by the webs which are arranged below the coolant spaces on the cylinders, the cylinder block and crankcase further include a cylinder section and a web-connecting partition, and the webs, the cylinder section and the web-connecting partition form a duct which, during the casting of the magnesium case around the aluminum power unit block, is filled by casting material.

14. The cylinder block and crankcase according to claim 13, wherein the bearing blocks have a groove-type indentation to increase regional cross-section of the transverse connections of the magnesium case, and crankshaft-bearing-side boundaries of the indentations are arranged at a distance from the center bearing plane of a divided crankshaft bearing which is sufficient for a load-bearing bearing cap connection in the bearing blocks.

15. The cylinder block and crankcase according to claim 14, wherein bearing blocks have lateral extensions with openings, which, during the casting of the magnesium case, are filled by casting material, for the clamping of the transverse connections of the magnesium case with the aluminum bearing blocks.

16. The cylinder block and crankcase according to claim 15, wherein the cylinders have stiffening ribs arranged between the deck and an underside of the coolant space approximately in the center between the web pairs of the screw channels.

17. The cylinder block and crankcase according to claim 16, further comprising bearing caps corresponding to the bearing blocks, wherein the bearing caps are integrated in a bearing frame, and wherein the crankshaft bearing comprises cast-in parts made of a ferrous material.

18. The cylinder block and crankcase according to claim 17, wherein the magnesium case includes venting and oil return flow ducts arranged over the two longitudinal sides, which ducts each have a rectangular cross-section oriented transversely to the longitudinal axis, the walls of the ducts are connected with longitudinal case ribs, and in connection areas of the ducts and longitudinal ribs, screw pockets designed for aluminum screws are provided for the connection of at least one of engine support elements and auxiliaries.

19. The cylinder block and crankcase according to claim 18, wherein on at least one of the bearing blocks, laterally oriented pins are arranged which penetrate the magnesium case and each have a screw-in thread for aluminum screws.

20. The cylinder block and crankcase according to claim 19, wherein the aluminum power unit block has sealing flanges which are constructed flush with the cylinders on the enveloping walls and cover the magnesium case.

* * * * *